US006576598B2

(12) United States Patent
Brown

(10) Patent No.: US 6,576,598 B2
(45) Date of Patent: Jun. 10, 2003

(54) BALLISTICS CONDITIONING

(76) Inventor: David Thomas Brown, 1952 Knob Hill Rd., Burlington, WI (US) 53105

( * ) Notice: Subject to any disclaimer, the term of this patent is extended or adjusted under 35 U.S.C. 154(b) by 0 days.

(21) Appl. No.: 09/934,600

(22) Filed: Aug. 22, 2001

(65) Prior Publication Data

US 2003/0078170 A1 Apr. 24, 2003

(51) Int. Cl.[7] ..... C10M 125/00; F42B 12/82

(52) U.S. Cl. ..... 508/118; 508/115; 508/116; 508/155; 508/148; 508/165; 508/167; 508/169; 508/219; 86/19; 102/448; 102/511; 42/76.02

(58) Field of Search ..... 86/19; 102/448, 102/511; 42/76.02; 508/118

(56) References Cited

U.S. PATENT DOCUMENTS

| | | | | |
|---|---|---|---|---|
| 2,442,155 | A | 5/1948 | Weese | 102/92.5 |
| 2,919,647 | A | 1/1960 | Dear et al. | 102/42 |
| 3,249,538 | A | 5/1966 | Freier | 252/18 |
| 3,356,029 | A | 12/1967 | Seidel | 102/92 |
| 3,390,080 | A | 6/1968 | Groszek | 252/25 |
| 3,909,424 | A | 9/1975 | Clark | 252/12 |
| 4,066,605 | A | 1/1978 | McBride et al. | 260/37 EP |

(List continued on next page.)

FOREIGN PATENT DOCUMENTS

| | | | |
|---|---|---|---|
| EP | 0 010 845 A1 | 5/1980 | F42B/11/02 |
| GB | 975331 | 11/1964 | C10M/7/00 |
| GB | 2 079 418 A | 1/1982 | F42B/7/04 |
| GB | 2 079 905 A | 1/1982 | F42B/7/00 |
| GB | 2 141 360 A | 12/1984 | B32B/15/00 |
| JP | 49096034 A | 9/1974 | C09D/5/08 |
| JP | 59174699 A | 10/1984 | C10M/7/02 |
| WO | WO 99/00468 | 1/1999 | C10M/111/04 |

OTHER PUBLICATIONS

Brennan, Dave. "Norma Introduces Moly–Coated–Bullet–Target–Cartridge Line." *Precision Shooting*, pp. 19–21, Aug. 1995.

Brown, David. "Moly . . . And It's Application For Ballistics Use." *Shooter's News*, pp. 32–42, Nov. 1997.

"Bullet Kote." KG Products. <http://www.rb–treasures.com/product2.html> Accessed Jun. 12, 1998. 3 pages.

Elliot, Larry. "Moly Coating, A New Revolution." *The Varmint Hunter*, Issue 22, pp. 161–167, Apr. 1997.

"Fastart: 'Moly' The Super Lubricant." Beslub International Ltd. 1995. <http://www.cam.org/~sailor/fast/moly.htm> Accessed May 10, 1997. 3 pages.

"Illustrated Mechanism of Molybdenum Disulfide Lubrication." Dow Corning Publication. 24 pages.

"Information About Dow Corning® Z–Moly–Powder." Dow Corning. 3 pages.

"KG Cleaning Products: KG–6 Moly Bore Prep." KG Cleaning Products. <http://www.rb–treasures.com/product1.html> p. 4. Accessed Jun. 12, 1998.

Luban, Bill. "Molybdenum, Graphite, Teflon® in Ballistics Applications." *Shooter's News*, pp. 70–74, Nov. 1997.

McPherson, M.L. "So Just Exactly How Does A Barrel Wear Out?" *Precision Shooting*, pp. 94–96, Nov. 1996.

(List continued on next page.)

*Primary Examiner*—Ellen M. McAvoy
(74) *Attorney, Agent, or Firm*—Wilhelm Law Service; Thomas D. Wilhelm

(57) ABSTRACT

Compositions and methods for ballistic conditioning firearm projectiles, firearms, and firearm components such as bores of barrels, by applying to such items a conditioning composition selected from the group consisting of hexagonal boron nitride, graphite, tungsten disulfide, antimony trioxide, talc, mica, and mixtures thereof, suspended in a carrier comprising a volatile solvent, and a binder selected from the group consisting of cellulosic-, alkyd- and acrylic-resins.

72 Claims, 3 Drawing Sheets

U.S. PATENT DOCUMENTS

| | | | | | |
|---|---|---|---|---|---|
| 4,196,670 | A | | 4/1980 | Vatsvog | 102/92.2 |
| 4,239,006 | A | | 12/1980 | Kelson | 102/93 |
| 4,328,750 | A | | 5/1982 | Oberg et al. | 102/514 |
| 4,454,175 | A | | 6/1984 | Martin | 427/242 |
| 4,465,883 | A | | 8/1984 | Lopata et al. | 585/9 |
| 4,731,189 | A | | 3/1988 | Gregg, Jr. | 252/23 |
| 4,735,146 | A | * | 4/1988 | Wallace | 102/511 |
| 4,808,324 | A | | 2/1989 | Periard et al. | 252/23 |
| 4,858,534 | A | | 8/1989 | Wallace | 102/511 |
| 5,062,974 | A | | 11/1991 | Van Meter | 252/11 |
| 5,116,521 | A | | 5/1992 | Fujii et al. | 251/18 |
| 5,233,128 | A | | 8/1993 | Lai | 102/511 |
| 5,341,744 | A | | 8/1994 | Shi | 102/442 |
| 5,372,154 | A | | 12/1994 | Bee et al. | 134/110 |
| 5,378,499 | A | | 1/1995 | Martin et al. | 427/242 |
| 5,719,352 | A | * | 2/1998 | Griffin | 102/517 |
| 5,970,877 | A | * | 10/1999 | Hensler | 102/288 |
| 6,090,756 | A | | 7/2000 | Brown | 508/118 |

OTHER PUBLICATIONS

"Methylene Chloride: MSDS No.: M4420." Material Safety Data Sheet. Mallincrodt Baker, Inc. <http://www.jtbaker.com/msds/m4420.htm> Accessed Jul. 20, 1999. 9 pages.

"More on Bullet Moly–Coating." *Precision Shooting*, p. 5, Feb. 1996.

"Neco–Coat™ Bullet Moly Coating." pp. 3–10.

"Saf–T–Eze Dry Moly™." Label. STL Compound Corporation, 1992.

Young, Charles F. "Molygrease—The Sequel." *Precision Shooting*, pp. 67–75, Dec. 1996.

Young, Charles F. "Moly–Lube, A Tried And Tested Art." *Precision Shooting*, pp. 63–71, Aug. 1996.

* cited by examiner

AC6004

HCP

BALLISTICS CONDITIONING

TECHNICAL FIELD

This invention relates to protective and lubricating coatings for metals. More particularly the invention concerns compositions and methods for applying dry protective and conditioning surface coatings to firearms, firearm components, and to firearm ammunition and ammunition elements.

BACKGROUND OF THE INVENTION

It has long been recognized in the ballistics field that slightly oversized projectiles engage the undersized bores of firearms through which they pass on firing and cause fouling. Firing frequently heats the bullet to the softening point and perhaps the melting point and also heats the firearm barrel through which the projectile is fired. Microscopic surface defects or irregularities in the barrel increase frictional forces and remove minute metal particles from the projectile. These particles become imbedded into the surface of the inner bore of the firearm barrel.

Projectiles are generally manufactured from materials which are softer, more malleable, and which have lower melting points than barrel alloy. Upon being fired, the projectile generally conforms to the dimensions of the interior surface of the barrel. Typically firearm projectiles are made of cast/swaged lead bullets or jacketed bullets with a copper outer jacket and a soft lead core swaged into the copper jacket. In the case of shotguns, the firearm projectiles are made of pellet shot which is usually carried in a plastic "wad" or capsule.

The heat of powder and primer ignition and the heat of friction during the internal ballistic experience are high for a few milliseconds. Barrels can become very hot with extended periods of use, and projectiles can become so hot that they begin to soften, flow or melt on their trip down the barrel.

Microscopic surface asperities of the bullet and barrel surfaces mutually abrade each other. This abrasive action, along with heat and pressure, permits minute particles of projectile surfaces to be transferred from the projectile surface to the bore surface. In early stages, this problem of minute bullet particle build-up on the bore surface is called "copper wash" or "lead wash". As the metallic build-up becomes more severe, such buildup is known as copper, lead, metal or plastic "fouling".

It is well known that metallic fouling and foreign material in firearm barrels adversely affects firing accuracy. Metallic fouling irregularly alters the internal dimensions of the bore. When a bullet passes over a bore irregularity, the path of the bullet is altered by heat and pressure which is created as the bullet is forced to conform to the bore irregularity. This can cause the bullet to become irregularly shaped, out of symmetry, and consequently out of balance. Such asymmetrical condition causes the fired bullet to yaw and wobble inconsistently during flight compared to other fired bullets from one shot to the next. Thus, firing accuracy is diminished. Foreign debris of powder and primer residue, and carbon are abrasive and, along with any dirt or grit in the barrel, create irregular wear patterns on the relatively soft barrel alloy, similarly contributing to decreased accuracy.

The above described problems have been addressed with varying degrees of success using various lubricants including waxes, greases, soaps and dry lubricants applied to bullets and/or firearm bore surfaces. Oils and greases do not adhere well to bullets or bore surfaces and may pick up abrasive dirt, dust, or grit, or can break down into acidic and/or corrosive agents. Under the extreme temperatures and pressures associated with firing bullets, oils typically are burned off and cannot add much lubrication or protection against corrosion. Thus, the waste products of oils can end up contributing to the fouling problem.

Moreover, a safety hazard may be created with greases or oils when these fluid lubricants are "snow plowed" ahead of a fired projectile traveling down a firearm barrel. Tremendous hydraulic pressure can result when excess such oil or grease is present on the projectile, and can cause pressure excursions that bulge or burst barrels and/or blow up the locking mechanism.

U.S. Pat. No. 4,858,534 to Wallace discloses use of a lubricating composition comprising a polyolefin-base oil, amorphous silicon dioxide, and disodium octaborate tetrahydrate disposed in an indented ring around a bullet for lubricating firearm barrels through which such bullets are fired.

To avoid the pitfalls associated with oil- and grease-type lubricants, various solid lubricants have been suggested in the art, especially with small caliber bullets. Small caliber bullets have traditionally employed a full metal jacket or hollow point wherein no lead is exposed on the nose of the bullet. Typically, these bullets are fired through expensive premium grade barrels on match rifles, the bores of which have been lapped and polished.

While some success has been seen with the coating of smaller caliber target bullets with the dry powdered materials, less success has been achieved with larger caliber bullets. The primary problem associated with larger caliber bullets arises because the maximum build-up of the powdered coating material is insufficient to provide acceptable lubrication. Consequently, there is not enough coating material actually adhering to the bearing surface of the bullet to survive the transit down the length of the barrel. This is especially true in the rougher barrels of mass produced rifles, e.g. hunting rifles, where the larger bullets are fired at greater velocities from cartridges which have higher powder capacities. Therefore, unless a regular and standard regimen of cleaning the firearm barrel is followed, typically with abrasive mechanical brushing and strong chemical solvents and/or polishing and cleaning compounds, metallic fouling persists.

Various methods have been suggested for applying a layer of dry powdered molybdenum disulfide to the surface of bullets to provide an adherent layer.

U.S. Pat. No. 4,454,175 to Martin teaches a method of impact plating the surfaces of lead bullets with powdered molybdenum disulfide. Such impact plating comprises tumbling the bullets in a ball mill containing powdered molybdenum disulfide and steel shot. Such process is applicable only to bullets and cannot be utilized for coating bullets in a fully loaded cartridge or for conditioning the inner bore of a firearm barrel.

For the latter purpose, Martin et al., in U.S. Pat. No. 5,378,499 teach lapping the bore of a firearm barrel by repeatedly firing through it bullets which have previously been coated with an abrasive such as diamond powder, boron nitride, boron carbide, silicon carbide, and the like.

To overcome the drawbacks associated with coating bullets with dry, powdered materials, various methods have been suggested which employ liquid compositions.

U.S. Pat. No. 4,196,670 to Vatsvog, for example, teaches a process for uniformly coating bullets with molybdenum disulfide lubricant by spray or dip coating the bullets with a suspension of molybdenum disulfide in an epoxy phenolic resin. Vatsvog further teaches that the wet-coated bullets are then allowed to air dry. For an effective and rapid cure of epoxy phenolic resins, however, the resin coating should be heat cured, which rules out coating of cartridges already assembled with propellant and igniter. If, on the other hand, the coating is allowed to air dry, long curing times are required before the coating is ready for its intended use, whereby such process is uneconomical.

U.S. Pat. No. 5,062,974 to Van Meter discloses a surface treatment for firearms and bullets comprising finely divided molybdenum disulfide, an alkali metal molybdate and a volatile organic solvent such as trichloroethane. Van Meter teaches that the sodium molybdate adheres to the underlying metal substrate, with the molybdenum disulfide adhering to the sodium molybdate.

U.S. Pat. No. 6,090,756, of common inventor ship herewith, teaches application of liquid suspensions of molybdenum disulfide compositions for ballistic conditioning purposes.

It is one object of the present invention to provide compositions and methods for applying a desired amount of a composition bonded as a coating to bullets and firearm components wherein the compositions are selected from hexagonal boron nitride ((h)BN), graphite 1, graphite 2, tungsten disulfide ($WS_2$), antimony trioxide ($Sb_2O_3$), mica, talc, or mixtures thereof. Antimony trioxide is also sometimes represented as $Sb_4O_6$.

It is another object of the invention to provide compositions and methods for applying desired amounts of such compositions as bonded coatings on other ballistics structures such as gun barrels, firearm chambers, fully assembled cartridges, shotgun wads, shot capsules and sabots.

It is a further object of the invention to provide compositions and methods which readily, easily, and cost effectively harden the interior barrel alloy surfaces of a firearm such that erosion of the barrel surface is minimized and such that the useful life of the barrel is extended.

It is yet another object of the invention to smooth out the interior surface of the barrel to eliminate or minimize fissures, pitting and/or, ruptures of the alloy surface.

It is another object of the invention to provide compositions and methods which readily, easily, provide cost effective repairs, and which heal, mend, and restore to a considerable extent the fissured, eroded, and degraded surfaces of used firearms.

It is also another object of the invention to provide compositions and methods which readily, easily, and cost effectively protect the interior and exterior surfaces of firearms from corrosive elements such as water, salt water, powder and primer corrosive by-products, environmental acids, and solvents.

It is another object of the invention to provide an environmentally safe protective coating to lead and other metallic shot which will not degrade to produce lead products in wetlands or in the digestive tracts of waterfowl.

It is also another object of the invention to provide a surface buffering zone to exterior surfaces of metallic bullet components to prevent oxidation, corrosion, etc. by applying hexagonal boron nitride, graphite 1, graphite 2, tungsten disulfide, antimony trioxide, talc, mica, or mixtures thereof, to respective product surfaces before, during and/or after steps in the manufacture or manufacturing use of swaged lead wire, molded lead bullets, bullet molds, sheet copper, copper billets, copper wire, jacketed bullets, molded/extruded plastics in shot wads, and ferrous alloys in firearm barrels, actions, and other firearm components.

It is a further object of the invention to provide compositions and methods which readily, easily, and cost effectively minimize or eliminate the need for frequent cleaning to remove metallic fouling, carbon and powder residue fouling and corrosion from firearms.

SUMMARY OF THE DISCLOSURE

These, and other objects are achieved by the present invention which provides conditioner materials in conditioning compositions for ballistic conditioning of firearms, firearm components, firearm projectiles, and loaded ammunition cartridges. Such conditioning composition comprises a liquid suspension of hexagonal boron nitride, graphite 1, graphite 2, tungsten disulfide, antimony trioxide, talc, mica, and mixtures thereof in a vehicle comprising a volatile solvent, and a binder selected from the group consisting of cellulosic resins, alkyd resins, acrylic resins, and mixtures thereof.

The invention further comprehends firearms, firearm components, firearm projectiles, and loaded ammunition cartridges coated with a conditioning layer comprising at least one of hexagonal boron nitride, graphite 1, or graphite 2, tungsten disulfide, antimony trioxide, talc, mica, and optionally combinations of such materials in combination with the resin binder.

In another set of embodiments, the invention comprehends methods for producing ballistic conditioned copper-clad bullets comprising applying a conditioning composition comprising at least one of hexagonal boron nitride, graphite 1, graphite 2, tungsten disulfide, antimony trioxide, talc, or mica, to sheet copper prior to forming the copper sheeting into jackets for such bullets.

In yet other embodiments of the present invention, there is provided a method of ballistic conditioning the bore of the barrel of a firearm, including a rifle, a shotgun or a hand gun, comprising applying to the bore a coating of a conditioning composition comprising particles of at least one of hexagonal boron nitride, graphite 1, graphite 2, tungsten disulfide, antimony trioxide, talc, mica, and mixtures thereof, in a carrier comprising a volatile solvent and a binder selected from the group consisting of cellulosic resins, alkyd resins, acrylic resins, and mixtures thereof. In some embodiments, the method includes subsequently heating the barrel to a temperature sufficient to cause the conditioning composition to interact or react with components of the barrel to increase the hardness of the bore at a surface region of the bore.

Figure 1:
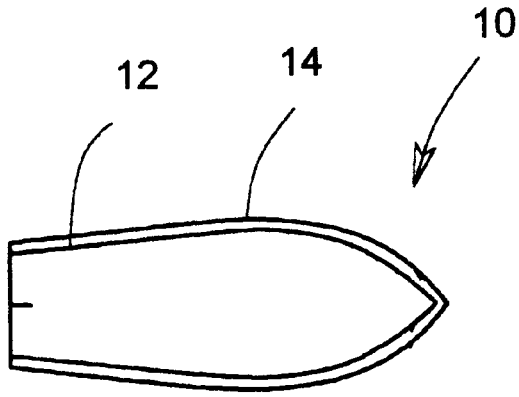
FIG. 1 shows a representative cross-section of a bullet coated in accord with the invention.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Referring to FIG. 1, a coated bullet 10 in accord with the present invention includes an underlying metal bullet substrate 12 coated with an overlying and firmly adhered first ballistic conditioning layer 14 comprising conditioner material and binder. The conditioner material is selected from the group consisting of hexagonal boron nitride, graphite 1, graphite 2, tungsten disulfide, antimony trioxide, talc, mica, and mixtures comprising any two or more of such conditioner materials.

Of the above group of conditioning materials, the hexagonal boron nitride is the most effective, and thus the most preferred. The next most effective, and thus next most preferred, materials are the graphite 1, graphite 2, and tungsten disulfide. Antimony trioxide, mica, and talc are generally used in combination with one or more of the preferred materials. While mica and talc are useful in combination with other materials, use of these materials without one of the more preferred materials in combination is generally not preferred.

Where a mixture of conditioning materials is used, a preferred second conditioner material is the antimony trioxide, which may act as an enhancer, whereby the resultant conditioning effect is greater than the proportionate conditioning affects of the respective materials taken individually.

Antimony trioxide, while having some utility by itself, is generally less effective than the more preferred materials, and thus not preferred for use as the only conditioning material. However, when added to one of the more preferred materials, e.g. hexagonal boron nitride, tungsten disulfide, graphite 1, or graphite 2, antimony trioxide serves to enhance the preferred conditioning properties of such preferred conditioning material. Any quantity of antimony trioxide, up to about 60% of the overall weight of the conditioning material solids content, can be used with the more preferred conditioning materials. However, when used as a property enhancer to improve the effect or efficiency of the more preferred conditioning material, the antimony trioxide is preferably used in amounts up to about 20% by weight, preferably about 5% to about 15% by weight, more preferably about 10% by weight, of the overall weight of conditioning material solids content.

The recited conditioner materials are all employed as suspensions of particulate materials, suspended in suitable liquid carrier compositions. Where such coating compositions, particles plus binder, tend to be generally colorless as applied to the substrate, a colorant such as a suitable dye or pigment can be employed in the conditioning composition as a color indicator to show that an acceptable application of the coating material has been achieved.

Figure 2:
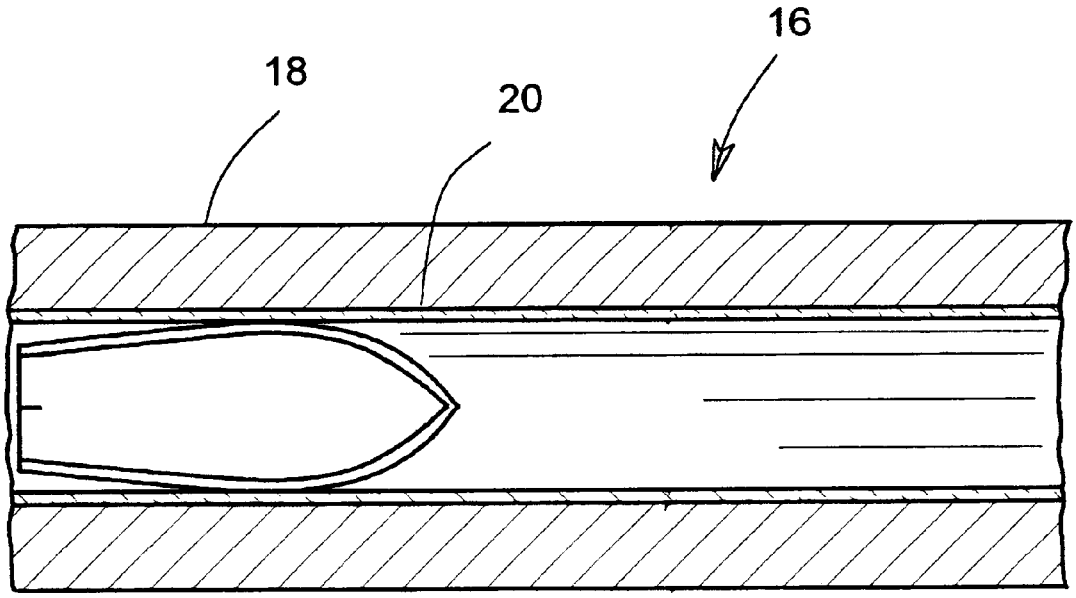
FIG. 2 shows a representative cross-section of a bullet coated according to the invention, in combination with a gun barrel coated according to the invention.

FIG. 2 shows bullet 10 inside a gun barrel 16. Gun barrel 16 has an underlying metal barrel substrate 18 and a second ballistic conditioning layer 20 comprising ballistic conditioner materials defined by at least one of hexagonal boron nitride, graphite 1, graphite 2, tungsten disulfide, antimony trioxide, talc, mica, and mixtures thereof.

In both FIGS. 1 and 2, as illustrated, the conditioning coating layers 14 and 20 are applied and bonded directly to the underlying metal substrates 12 and 18 respectively using ballistic conditioning compositions. Such ballistic conditioning compositions comprise powdered conditioner material in corresponding liquid carrier, comprising volatile solvent and preferably rapid air-drying cellulosic resin, alkyd resin, or acrylic resin binder, or combination of such resins.

The composition of the carrier is selected such that the carrier performs a variety of functions, exemplary ones of which are discussed hereinafter. First, the carrier is a suspending agent, acting to suspend particles of the conditioner material for at least sufficient time to enable effective application of the suspension to the substrate surface being conditioned.

Second, the carrier operates to disperse the conditioner material particles/platelets evenly in the formulation, to obtain a relatively uniform spray dispersion of the conditioner material as the conditioner material is applied to a substrate, and to encapsulate the conditioner material particles with binder on the substrate surface, so as to promote effective adherence of the conditioner material to the surface.

Third, the carrier has sufficiently fluidity, and sufficient surface tension, with respect to the surfaces to which the conditioning composition is to be applied, that the carrier quickly flows to uniformly cover the substrate surface with a uniform liquid film before the carrier solvent evaporates to thereby leave behind a respective generally uniform and unitary coating layer of conditioner material and binder on the surface of the substrate.

Fourth, the carrier solvent has sufficiently high volatility that the solvent mostly evaporates within a few seconds or minutes after the liquid conditioning composition has been applied to the substrate surface, depending on the application conditions, and preferably evaporates within no more than five to fifteen seconds of such application, at a temperature of at least about 100° F. (~37.8° C.).

Fifth, the resin binder contained in the carrier should have a thermal setting point such that the binder rapidly dries and cures at ambient temperatures or temperatures slightly above ambient.

The time needed for complete curing of the coating depends on variable conditions of e.g. temperature, humidity, and air movement. The resin takes longer to cure than the time required for the bulk of the solvents to evaporate.

With the above desirable properties of the carrier in mind, a suitable conditioning composition is made in accord with the present invention by suspending a suitable quantity of selected powdered conditioner material in a correspondingly suitable quantity of a mixture of solvents and binder resin.

A suitable quantity of hexagonal boron nitride is about 0.2 lb. (0.09 kg.) to about 0.65 lb (0.29 kg) (h)BN in about 1 gallon (3.8 L) of a mixture of solvents and binder resin. A suitable quantity of tungsten disulfide is about 1.1 lbs. (0.5 kg) to about 1.9 lbs. (0.86 kg) $WS_2$ in about 1 gallon (3.8 L) of a mixture of solvents and binder resin. A suitable quantity of antimony trioxide is about 0.6 lb. (0.27 kg) to about 1.4 lbs. (0.63 kg) $Sb_2O_3$ in about 1 gallon (3.8 L) of a mixture of solvents and binder resin.

Figure 3:
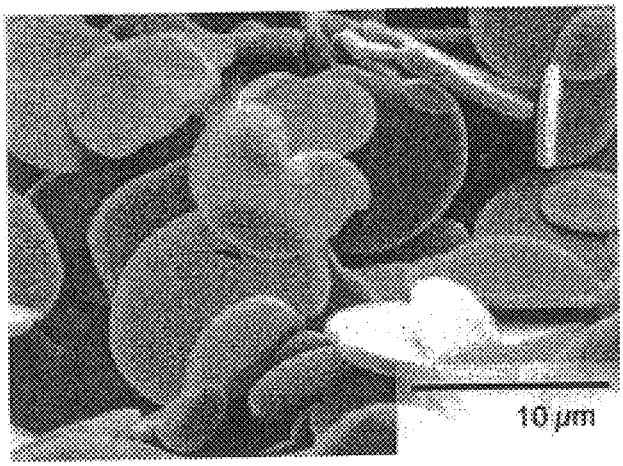
FIG. 3 shows a magnified view of a first embodiment of hexagonal boron nitride powder.
Figure 4:
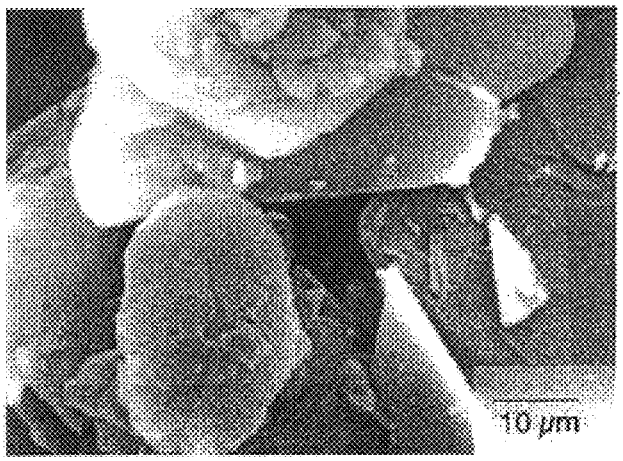
FIG. 4 shows a magnified view of a second embodiment of hexagonal boron nitride powder.

Suitable conditioner materials are available as powders from a number of suppliers. Preferred (h) boron nitride materials are sold under product designations AC6004 and HCP, both by Advanced Ceramics Corporation, Lakewood, Ohio. FIG. 3 shows an enlarged view of a collection of AC6004 particles. FIG. 4 shows an enlarged view of a collection of HCP particles. As seen in FIGS. 3 and 4, hexagonal boron nitride particles tend to be shaped as platelets.

Suitable solvents for use in the formulations of the present invention include solvents known to those skilled in the paint and coatings arts. These include hydrocarbons such as $C_1$–$C_{10}$ alkanes, toluene, xylenes and the like; alcohols such as ethanol, n-propanol, iso-propanol, butanol, and the like; esters such as ethyl acetate, butyl acetate, dibutyl phthalate, cellosolve acetate, Monsanto PolySolv® EE acetate, and the like; and ketones such as acetone, methyl isobutyl ketone (MIBK), and the like. Suitable such solvents and solvent combinations can be readily selected by those skilled in the coatings art.

Binder resins utilized in conditioning compositions of the invention are selected from the families of cellulosic-based resins, alkyd-based resins, and acrylic-based resins, and mixtures of such resins which, when carried in suitable solvents, dry and cure rapidly at temperatures at or slightly above ambient to produce generally uniform films. Such binder resins are compatible with the temperatures and pressures commonly encountered in a gun barrel when a cartridge is fired. Suitable binder resins for the conditioning compositions of the invention are readily identifiable by those skilled in the paint and coating arts and include cellulosic binders such as cellulose nitrate, ethyl cellulose, cellulose acetate, cellulose acetate butyrate, methyl cellulose, and the like.

Where improved adhesion to metal is desired, oxidizing types of alkyd resins are indicated. These commonly used "short, medium and long" alkyd resins are described in the scientific literature by their length and their source of origin. They include "short" alkyd resins such as castor-oil alkyd, soya alkyd, linseed-C.W.O phenolated alkyd, stryenated alkyd, coconut-oil alkyd; "medium" alkyd resins such as linseed modified alkyd oil-free alkyd, soya-linseed alkyd; and "Hi-Drink" soya-tung alkyd.

Alkyd resins derived from linseed-, soya-, coconut-, and dehydrated castor oil-alkyds, and alkyds from other vegetable sources, are suitable selections. Natural gum resins for use as additional resin film fortifiers to improve adhesion include maleic, elemi, dammar and shellac. The blending of cellulosic and acrylic resins with alkyds as a plasticizer provides a greatly enlarged number of workable combinations. When hard organic natural resins further replace some the alkyd solids, an even greater range of formulations is possible.

The following representative coating formulations containing the conditioner materials are provided for illustrative purposes only, and should not be read as limiting the scope of the present invention.

FORMULATION 1

| Cellulosic Based | |
|---|---|
| Boron Nitride | 2.2–6.0 lb |
| (6–15$\mu$ average particle size) | (1.0–2.7 kg) |
| ½ Sec. Cellulose nitrate (75% N.V. in ethanol) | 160 lb (75.6 kg) |
| Toluene or xylenes | 245 lb (111.1 kg) |
| Dibutyl phthalate | 53 lb (24.0 kg) |
| Ethyl acetate | 157 lb (71.2 kg) |
| Butyl acetate | 109 lb (49.4 kg) |
| Butanol | 01 lb (45.8 kg) |
| Commercial shellac solution | 69 lb (31.3 kg) |

FORMULATION 2

| Cellulosic Based | |
|---|---|
| Boron Nitride | 2.2–6.0 lb |
| (6–15$\mu$ average particle size) | (1.0–2.7 kg) |
| Cellulose nitrate laquer | 1 Gallon (3.8 L) |

FORMULATION 3

| Cellulosic Based | |
|---|---|
| Boron Nitride | 2.2–6.0 lb |
| (6–15$\mu$ average particle size) | (1.0–2.7 kg) |
| Ethyl cellulose laquer | 1 Gallon (3.8 L) |

FORMULATION 4

| Cellulosic Based | |
|---|---|
| Boron Nitride | 2.2–6.0 lb |
| (6–15$\mu$ average particle size) | (1.0–2.7 kg) |
| Cellulose acetate/butyrate laquer | 1 Gallon (3.8 L) |

FORMULATION 5

| Cellulosic Based Blend | |
|---|---|
| Boron Nitride | 2.2–6.0 lb |
| (6–15$\mu$ average particle size) | (1.0–2.7 kg) |
| Mixed with 1 gallon (3.8 L) of a carrier comprising: | |
| Cellulose nitrate laquer | ⅓ gallon (1.26 L) |
| Ethyl cellulose laquer | ⅓ gallon (1.26 L) |
| Cellulose acetate/butyrate Laquer | ⅓ gallon (1.26 L) |

FORMULATION 6

| Cellulosic/Alkyd Based Blend | |
|---|---|
| Boron Nitride | 2.2–6.0 lb |
| (6–15$\mu$ average particle size) | (1.0–2.7 kg) |
| Mixed with 1 gallon (3.8 L) of a carrier comprising: | |
| 1/4 Sec. Cellulose nitrate 75% N.V. in ethanol | 15.5 parts by weight |
| Toluene (xylenes) | 37.9 parts by weight |
| Butyl acetate | 22.9 parts by weight |
| Dibutyl phthalate | 5.2 parts by weight |
| Alkyd, non-drying, 60 N.V. | 18.5 parts by weight |

FORMULATION 7

| Alkyd Based | |
|---|---|
| Boron Nitride | 2.2–6.0 lb |
| (6–15$\mu$ average particle size) | (1.0–2.7 kg) |
| Mixed with 1 gallon (3.8 L) of a carrier comprising: | |
| Tall oil fatty acids | 47.6 parts by weight |
| Pentaerythritol | 23.8 parts by weight |
| Phthalic anhydride | 28.6 parts by weight |

FORMULATION 8

| Cellulosic/Acrylic Based | |
|---|---|
| Boron Nitride | 2.2–6.0 lb |
| (6–15$\mu$ average particle size) | (1.0–2.7 kg) |
| Mixed with 1 gallon (3.8 L) of a carrier comprising: | |
| DuPont 2044 Elvacite ® soft Solid Acrylic Solution #1 | 1.8 parts by weight |
| DuPont PD-14-P cellulose Nitrate, ½ sec. | 13.0 parts by weight |
| Methyl isobutyl ketone | 31.9 parts by weight |
| Thinner (59% toluene, 25% MIBK, 10% isopropyl alcohol, 6% Shell Chemical Co. Penatoxone ®) | 53.3 parts by weight |

FORMULATION 9

| Aerosol Acrylic Based | |
|---|---|
| Boron Nitride | 2.2–6.0 lb |
| (6–15$\mu$ average particle size) | (1.0–2.7 kg) |
| Mixed with 1 gallon (3.8 L) of a carrier comprising: | |
| DuPont Elvacite ® 6014 Acrylic Resin #3 | 17.1 parts by weight |
| Toluene or equivalent | 14.9 parts by weight |
| Acetone | 13.8 parts by weight |
| Methyl isobutyl ketone | 4.6 parts by weight |
| Monsanto Poly-Solv EE acetate | 3.6 parts by weight |
| Monsanto Santicizer 160 | 1.0 part by weight |
| Propane/isobutane/heptane propellants | 45 parts by weight |

FORMULATION 10

| Alcohol-Based Acrylic Spray | |
|---|---|
| Boron Nitride | 2.2–6.0 lb |
| (6–15$\mu$ average particle size) | (1.0–2.7 kg) |
| Mixed with 1 gallon (3.8 L) of a carrier comprising: | |
| DuPont 2045 6016 Elvacite ® alcohol soluble acrylic resin | 10 parts by weight |
| Isopropyl alcohol | 25 parts by weight |
| n-Propyl alcohol | 40 parts by weight |
| Shell Chemical Co. Pentoxone ® | 25 parts by weight |

FORMULATION 11

| Cellulosic Based | |
|---|---|
| Tungsten Disulfide | 12.1–17.4 lb |
| (0.5–4$\mu$ average particle size) | (5.5–7.9 kg) |
| ½ Sec. Cellulose nitrate (75% N.V. in ethanol) | 160 lb (75.6 kg) |
| Toluene or xylenes | 245 lb (111.1 kg) |
| Dibutyl phthalate | 53 lb (24.0 kg) |
| Ethyl acetate | 157 lb (71.2 kg) |
| Butyl acetate | 109 lb (49.4 kg) |
| Butanol | 101 lb (45.8 kg) |
| Commercial shellac solution | 69 lb (31.3 kg) |

FORMULATION 12

| Cellulosic Based | |
|---|---|
| Tungsten Disulfide | 12.1–17.4 lb |
| (0.5–4$\mu$ average particle size) | (5.5–7.9 kg) |
| Cellulose nitrate laquer | 1 Gallon (3.8 L) |

FORMULATION 13

| Cellulosic Based | |
|---|---|
| Tungsten Disulfide | 12.1–17.4 lb |
| (0.5–4$\mu$ average particle size) | (5.5–7.9 kg) |
| Ethyl cellulose laquer | 1 Gallon (3.8 L) |

FORMULATION 14

| Cellulosic Based | |
|---|---|
| Tungsten Disulfide | 12.1–17.4 lb |
| (0.5–4$\mu$ average particle size) | (5.5–7.9 kg) |
| Cellulose acetate/butyrate laquer | 1 Gallon (3.8 L) |

FORMULATION 15

| Cellulosic Based Blend | |
|---|---|
| Tungsten Disulfide | 12.1–17.4 lb |
| (0.5–4$\mu$ average particle size) | (5.5–7.9 kg) |
| Mixed with 1 gallon (3.8 L) of a carrier comprising: | |
| Cellulose nitrate laquer | ⅓ gallon (1.26 L) |
| Ethyl cellulose laquer | ⅓ gallon (1.26 L) |
| Cellulose acetate/butyrate Laquer | ⅓ gallon (1.26 L) |

FORMULATION 16

| Cellulosic/Alkyd Based Blend | |
|---|---|
| Tungsten Disulfide | 12.1–17.4 lb |
| (0.5–4$\mu$ average particle size) | (5.5–7.9 kg) |
| Mixed with 1 gallon (3.8 L) of a carrier comprising: | |
| ¼ Sec. Cellulose nitrate 75% N.V. in ethanol | 15.5 parts by weight |
| Toluene (xylenes) | 37.9 parts by weight |
| Butyl acetate | 22.9 parts by weight |
| Dibutyl phthalate | 5.2 parts by weight |
| Alkyd, non-drying, 60% N.V. | 18.5 parts by weight |

FORMULATION 17

| Alkyd Based | |
|---|---|
| Tungsten Disulfide | 12.1–17.4 lb |
| (0.5–4$\mu$ average particle size) | (5.5–7.9 kg) |
| Mixed with 1 gallon (3.8 L) of a carrier comprising: | |
| Tall oil fatty acids | 47.6 parts by weight |
| Pentaerythritol | 23.8 parts by weight |
| Phthalic anhydride | 28.6 parts by weight |

FORMULATION 18

| Cellulosic/Acrylic Blend | |
|---|---|
| Tungsten Disulfide | 12.1–17.4 lb |
| (0.5–4μ average particle size) | (5.5–7.9 kg) |
| Mixed with 1 gallon (3.8 L) of a carrier comprising: | |
| DuPont 2044 Elvacite ® soft Solid Acrylic Solution #1 | 1.8 parts by weight |
| DuPont PD-14-P cellulose Nitrate, ½ sec. | 13.0 parts by weight |
| Methyl isobutyl ketone | 31.9 parts by weight |
| Thinner (59% toluene, 25% MIBK, 10% isopropyl alcohol, 6% Shell Chemical Co. Penatoxone ®) | 53.3 parts by weight |

FORMULATION 19

| Aerosol Acrylic Based | |
|---|---|
| Tungsten Disulfide | 12.1–17.4 lb |
| (0.5–4μ average particle size) | (5.5–7.9 kg) |
| Mixed with 1 gallon (3.8 L) of a carrier comprising: | |
| DuPont Elvacite ® 6014 Acrylic Resin #3 | 17.1 parts by weight |
| Toluene or equivalent | 4.9 parts by weight |
| Acetone | 13.8 parts by weight |
| Methyl isobutyl ketone | 4.6 parts by weight |
| Monsanto Poly-Solv EE acetate | 3.6 parts by weight |
| Monsanto Santicizer 160 | 1.0 part by weight |
| Propane/isobutane/heptane propellants | 45 parts by weight |

FORMULATION 20

| Alcohol-Based Acrylic Spray | |
|---|---|
| Tungsten Disulfide | 12.1–17.4 lb |
| (0.5–4μ average particle size) | (5.5–7.9 kg) |
| Mixed with 1 gallon (3.8 L) of a carrier comprising: | |
| DuPont 2045 6016 Elvacite ® alcohol soluble acrylic resin | 10 parts by weight |
| Isopropyl alcohol | 25 parts by weight |
| n-Propyl alcohol | 40 parts by weight |
| Shell Chemical Co. Pentoxone ® | 25 parts by weight |

FORMULATION 21

| Cellulosic Based | |
|---|---|
| Antimony Trioxide | 6.6–1 2.8 lb |
| (0.4–3μ average particle size) | (3.0–5.8 kg) |
| ½ Sec. Cellulose nitrate (75% N.V. in ethanol) | 160 lb (75.6 kg) |
| Toluene or xylenes | 245 lb (111.1 kg) |
| Dibutyl phthalate | 53 lb (24.0 kg) |
| Ethyl acetate | 157 lb (71.2 kg) |
| Butyl acetate | 109 lb (49.4 kg) |
| Butanol | 101 lb (45.8 kg) |
| Commercial shellac solution | 69 lb (31.3 kg) |

FORMULATION 22

| Cellulosic Based | |
|---|---|
| Antimony Trioxide | 6.6–12.8 lb |
| (0.4–3μ average particle size) | (3.0–5.8 kg) |
| Cellulose nitrate laquer | 1 Gallon (3.8 L) |

FORMULATION 23

| Cellulosic Based | |
|---|---|
| Antimony Trioxide | 6.6–12.8 lb |
| (0.4–3μ average particle size) | (3.0–5.8 kg) |
| Ethyl cellulose laquer | 1 Gallon (3.8 L) |

FORMULATION 24

| Cellulosic Based | |
|---|---|
| Antimony Trioxide | 6.6–12.8 lb |
| (0.4–3μ average particle size) | (3.0–5.8 kg) |
| Cellulose acetate/butyrate laquer | 1 Gallon (3.8 L) |

FORMULATION 25

| Cellulosic Based Blend | |
|---|---|
| Antimony Trioxide | 6.6–12.8 lb |
| (0.4–3μ average particle size) | (3.0–5.8 kg) |
| Mixed with 1 gallon (3.8 L) of a carrier comprising: | |
| Cellulose nitrate laquer | ⅓ gallon (1.26 L) |
| Ethyl cellulose laquer | ⅓ gallon (1.26 L) |
| Cellulose acetate/butyrate Laquer | ⅓ gallon (1.26 L) |

FORMULATION 26

| Cellulosic/Alkyd Based Blend | |
|---|---|
| Antimony Trioxide | 6.6–12.8 lb |
| (0.4-3p average particle size) | (3.0–5.8 kg) |
| Mixed with 1 gallon (3.8 L) of a carrier comprising: | |
| ¼ Sec. Cellulose nitrate 75% N.V. in ethanol | 15.5 parts by weight |
| Toluene (xylenes) | 37.9 parts by weight |
| Butyl acetate | 22.9 parts by weight |
| Dibutyl phthalate | 5.2 parts by weight |
| Alkyd, non-drying, 60% N.V. | 18.5 parts by weight |

FORMULATION 27

| Alkyd Based | |
|---|---|
| Antimony Trioxide | 6.6–12.8 lb |
| (0.4–3μ average particle size) | (3.0–5.8 kg) |
| Mixed with 1 gallon (3.8 L) of a carrier comprising: | |
| Tall oil fatty acids | 47.6 parts by weight |
| Pentaerythritol | 23.8 parts by weight |
| Phthalic anhydride | 28.6 parts by weight |

FORMULATION 28

| Cellulosic/Acrylic Blend | |
|---|---|
| Antimony Trioxide (0.4–3μ average particle size) | 6.6–12.8 lb (3.0–5.8 kg) |
| Mixed with 1 gallon (3.8 L) of a carrier comprising: | |
| DuPont 2044 Elvacite ® soft Solid Acrylic Solution #1 | 1.8 parts by weight |
| DuPont PD-14-P cellulose Nitrate, ½ sec. | 13.0 parts by weight |
| Methyl isobutyl ketone | 31.9 parts by weight |
| Thinner (59% toluene, 25% MIBK, 10% isopropyl alcohol, 6% Shell Chemical Co. Penatoxone ®) | 53.3 parts by weight |

FORMULATION 29

| Aerosol Acrylic Based | |
|---|---|
| Antimony Trioxide (0.4–3μ average particle size) | 6.6–12.8 lb (3.0–5.8 kg) |
| Mixed with 1 gallon (3.8 L) of a carrier comprising: | |
| DuPont Elvacite ® 6014 Acrylic Resin #3 | 17.1 parts by weight |
| Toluene | 14.9 parts by weight |
| Acetone | 13.8 parts by weight |
| Methyl isobutyl ketone | 4.6 parts by weight |
| Monsanto Poly-Solv EE acetate | 3.6 parts by weight |
| Monsanto Santicizer 160 | 1.0 part by weight |
| Propane/isobutane/heptane propellants | 45 parts by weight |

FORMULATION 30

| Alcohol Based Acrylic Spray | |
|---|---|
| Antimony Trioxide (0.4–3μ average particle size) | 6.6–12.8 lb (3.0–5.8 kg) |
| Mixed with 1 gallon (3.8 L) of a carrier comprising: | |
| DuPont 2045 6016 Elvacite ® alcohol soluble acrylic resin | 10 parts by weight |
| Isopropyl alcohol | 25 parts by weight |
| n-Propyl alcohol | 40 parts by weight |
| Shell Chemical Co. Pentoxone ® | 25 parts by weight |

Similar illustration can be given for graphite 1, graphite 2, mica, and talc, whereby the volumetric quantity of the conditioner material is held generally constant in a given volume of solvent and binder irrespective of which conditioning material, or conditioning materials, are being used in the conditioning composition.

Preferred method of applying the conditioning composition to bullets is e.g. as an aerosol spray. In such spray application, the particles of the conditioner material should be sufficiently small to pass through the atomizing orifice, and to be atomized at pressures conventionally carried in aerosol products marketed for consumer use. To that end, no particle should be greater than about 35 microns. Preferred particle size is no more than 15 microns. Highly preferred particulate material has average particle size of about 2 microns to about 6 microns, and a size range of up to no more than about 20 microns, preferably no more than about 12 microns.

The above compositions hold the conditioner material particles in suspension for the requisite time to enable the composition to be applied to any suitable surface for creating a ballistic conditioning layer on the respective surface.

Articles can be coated with the above compositions, for example, by airless spraying, air-assisted spraying, air brush, spray pumper, wicking or wiping, brushing as with a paint brush, dip coating, immersion, quenching, tumbling, auguring and the like. Virtually any application method can be used to bring the liquid composition into contact with the surface to be coated, and thereby conditioned, with the selected conditioning composition.

Tumbling and augering of the prepared liquid suspension of coating material with e.g. large batches of bullets to be coated can be effective under certain conditions. For example, a stand-alone cement mixer-size container, or an augering device containing a first suitable quantity of bullets and a second suitable quantity of coating material can be slowly turned until the surfaces of the bullets are coated.

To protect against damage to the bullets, and to help apply the coating material, tumbling media such as small, hard grains of e.g. rice, wheat, rye, barley, and the like, or small plastic pellets or beads can be added to the tumbling container or auger. The tumbling media serves as a transfer agent for transferring the liquid coating material to the relatively larger bullets, while providing some cushioning of the tumbling action to prevent damage to the bullets as the bullets potentially impact each other. However, where smaller size bullets are being coated, the bullets themselves can appropriately function as the transfer agents.

The coating composition is preferably metered into the mixer or auger on an as needed basis, for example and without limitation, by spray gun, aerosol can, or pump sprayer as the batch progresses, while keeping the container or auger substantially closed to retard premature evaporation of solvent, as some solvent is required to effect the desired uniformity of thickness of the coating layer. Such tumbling or augering methods require monitoring, but can provide a preferred level of control and uniformity in the coatings.

In preferred aerosol methods of applying the coating formulations of the invention, suitable propellants can be added to the above exemplary combinations of conditioner material and suspending liquids, permitting the application of the suspended conditioner material from e.g. an aerosol can. To that end, one or more suitable propellants can be added to the above compositions, for example in amounts of 5–10 parts by weight heptane, 5–10 parts by weight propane, and 20–25 parts by weight isobutane, based on an overall 100 parts of conditioning composition plus propellant. Such combination is quite suitable for applying such conditioning compositions of the invention as coatings to surfaces of a wide variety of substrates including lead and copper-clad bullets; fully loaded cartridges; lead shot; and rifle, shotgun, and hand-gun bores and chambers.

In the manufacture of bullets and bullet jackets made from lead wire, copper wire, etc., preferably the conditioning composition suspension is applied to the wire after the wire has been heated to 80° F. (~27° C.) or more by being first drawn through a reducing die. Subsequent applications of the conditioning composition can be made, as needed to achieve the desired effective coating, before or after transit through subsequent drawing dies, reducing dies, forming dies, swaging dies, or other working dies.

Exemplary beneficial effects of applying the conditioning composition in early stages of drawing a wire, the bullet or the bullet jacket operations are:

1) The conditioning composition is most quickly, efficiently and economically applied in the manufacturing line/process without substantial labor expense.

2) The presence of the conditioning composition on the substrate wire surface will help prevent oxidation of the lead and copper wire and thus will help prevent the accumulation of unwanted contaminants (dirt, dust, grit, etc.) thus eliminating the otherwise necessary steps of cleaning the wire or scrapping contaminated manufacturing materials.

3) The presence of the conditioning composition on the wire will reduce or eliminate the rending, tearing, splitting, and pitting of the substrate surface which are typical negative conditions found in the drawing/reducing/forming process. The surface coating of the conditioning composition will appear to be uniformly smooth after the drawing through the dies. On the microscopic level, the substrate surface will be relatively more uniform, more intact, and smooth with fewer rough asperites, splits, tears, and pitting; and the magnitudes of such deformities are typically less where the conditioner material is used.

4) The bearing, contact surfaces of the ferrous reducing/forming dies will, in some instances, be hardened by the formation of a thin intermetallic zone of derivatives of the conditioner material, for example carbides and ferrous carbides, on the die surface.

The conditioning composition coated and conditioned wire may also be used as the core of jacketed bullets. Lead wire so conditioned will be free of oxides and will be smoother, thus eliminating cleaning or discarding of otherwise unusable lead wire. The lead wire cores will be relatively free of surface flaws and irregularities. The wire will process through cutting dies, shaping dies, swaging dies, forming dies and other dies better than unconditioned wire.

In the manufacture of bullet jackets, the present invention contemplates application of the conditioning composition to the substrate surface early in the manufacturing process. The composition should be initially applied during or shortly after the rolling of the sheet copper at the mill. This factory-applied coating to copper sheet will protect the newly formed copper surface from oxidation and contamination. This coating may or may not be burnished into the substrate surface in such quantities that the coating will be present through subsequent operations.

Copper bullet jackets are typically stamped out of sheet copper by presses. The jackets are forwarded to punch presses where 'billets' are drawn into 'cups' (pre-bullet jackets) or 'jackets'. It is contemplated that the suspension of the present invention be applied to the copper cups/jackets as the cups/jackets are drawn or formed into shape. The resulting surface of the copper cup will be more uniform, smooth and relatively free of microscopic irregularities and flaws. The resulting product is a conditioned bullet jacket ready for the insertion of the lead core and shaping in the swaging/forming die. The result of the swaging/forming operation is the finished bullet, coated with a layer of the ballistic conditioner material. A final application of the conditioning composition may be desired after bullet formation, for a complete, uniform, unmarked and attractive coating.

In the manufacture of cast bullets, the present invention contemplates coating and conditioning the interior surface of bullet casting molds with conditioning compositions of the invention 1) to provide a mold release agent for the bullets, 2) to smooth the casting surface and thereby smooth the surface of the finished cast bullet, and 3) to transfer a portion of the conditioning composition residing on the mold surface to the surface of the molded bullets.

Figure 5:
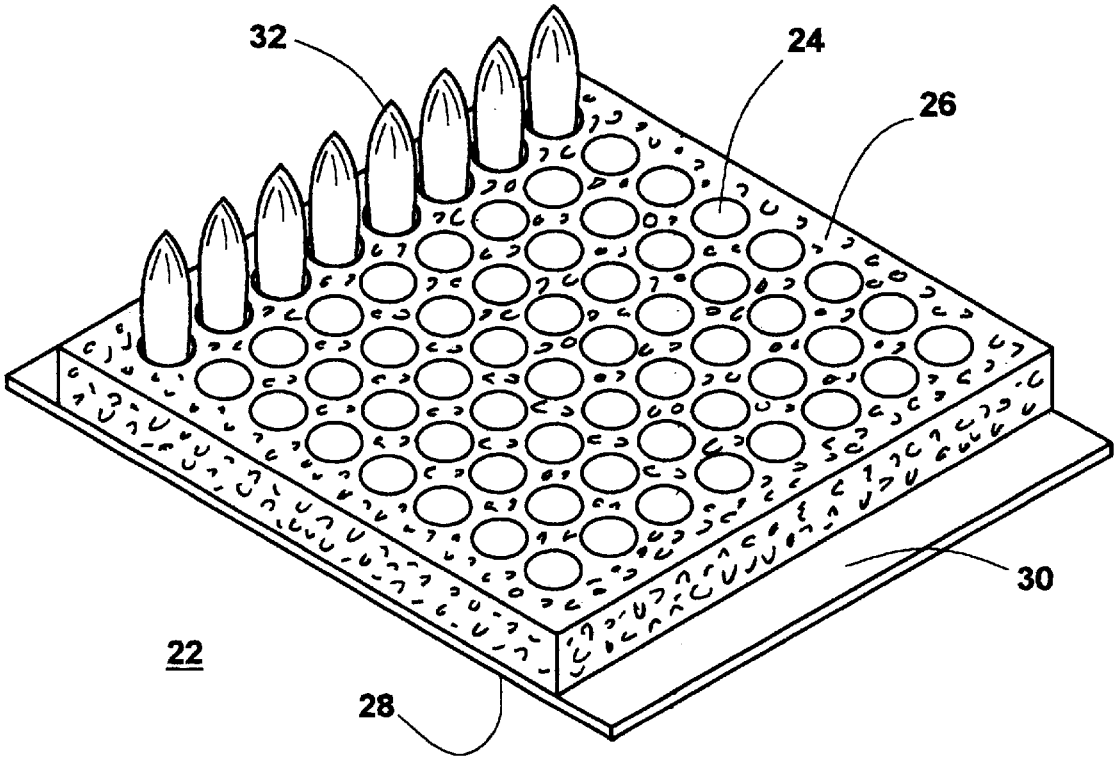
FIG. 5 shows a perspective view of a bullet or shell organizer useful for placing bullets upright in close array for quick and easy spray-coating in accord with one embodiment of the invention.

For applying the above conditioning composition suspension to coat bullets as shown in FIG. 1, wherein the bullets have already been formed, the bullets 32 may be arranged in an array, and held in such array by an organizer 22 as illustrated in FIG. 5. As illustrated in FIG. 5, organizer 22 can be a sheet of a resilient, soft material such as polyethylene foam or polystyrene foam, having an array of holes 24 extending therethrough from the top surface 26 to the bottom surface 28 of the organizer. The foam material is selected in terms of softness and resilience, and the holes are appropriately sized, such that a variety of sizes of bullets 10 can be inserted into the respective holes. The array of bullets in the organizer 22 is thus suitably presented for spray application of the conditioning composition suspension to the bullets. The holes 24 are large enough that larger size bullets can be placed upright in the holes on a suitable shield 30 larger than the organizer, similar to placing an article to be spray-painted on a suitable shield to catch the overspray of paint. The bullets are suitably supported against falling over while the array is being set up. When the array of bullets is properly set up, and with the bullets confined within the holes, but not gripped by the sidewalls, organizer 22 is lifted carefully up and out of the array. The bullets are thus arranged in the array on the spray shield, with the organizer removed from the array.

The above ballistic conditioning liquid coating composition is then spray applied to the bullets as a sweeping spray from a suitable aerosol container, much like spray applying paint from an aerosol container. Since the conditioner material is in a suspension, not a solution, the user first shakes the can to disperse the solid particles.

The shield catches the overspray. The organizer is then rotated about a vertical axis, for example 180 degrees, or the person applying the spray can move around the array, to present what was the back side of the bullets as previously sprayed, and the bullets are again sprayed. Additional sprays can be applied at e.g. 90 and 270 degrees if desired, to provide a generally uniform coating to the bullets.

As each spray application is applied to the bullets, between the rotations, the liquid is deposited in a relatively uniform coating on each of the sprayed bullets. The coating quickly coalesces such that the coating is generally unitary as respects that particular application of the suspension liquid. The liquid carrier then evaporates, leaving a dry coating of substantially pure (e.g. 97–99% pure) coating composition, e.g. conditioner material plus binder, in direct contact with the underlying substrate surface.

In the case of loaded cartridges, the organizer can be kept in place during the spraying step.

A surface temperature of 80° F. (~27° C.) to 140° F. (~60° C.) or 150° F. (~66° C.) is preferred for application of the conditioning composition to bullets. The bullets can be warmed prior to application of the spray composition by any convenient method such as solar radiation, an electric hair dryer, a hot air gun, the use of heat lamps, or heating the bullets in a common kitchen oven. This heating is to provide a simple method of assuring that the composition will rapidly dry in place producing a thin, even coating without running or weeping of the conditioning composition material.

As with any metal coating, the substrate must be clean down to bare metal in order to obtain suitable adhesion of the ballistic coating composition material, with no effective presence of e.g. oil, dirt, grease, film, or the like as adhesion of the coating material is occurring. As typically happens with dirty substrates, the ballistic coating compositions of the invention can adhere to certain contaminating films rather than to the substrate, whereby the coating is lost at any time the film is later removed from the substrate. Degreasing with solvents or detergents followed by hot water rinse is preferred, to obtain desired adhesion between the ballistic conditioning coating composition and the substrate.

By applying a series of coating sprays to the array of bullets in the organizer, from different angles, the bullets are generally uniformly coated with a suitable coating of the conditioning composition, typically about 0.002 inch (0.05 mm) thick, with general range of thicknesses of about 0.002 inch (0.05 mm) to about 0.005 inch (0.13 mm) per spray pass. Multiple spray passes can be used to achieve coating thickness as desired. Thus, coatings as thick as 0.0025 inch (0.064 mm) to about 0.01 inch (0.25 mm) are contemplated. As used herein, "coating thickness" means after evaporation of substantially all of any volatile solvent and after cure of the resin.

The coating as applied from liquid suspension does not flake off, nor does the coating generally rub off onto a user's hands. The liquid-applied coating survives intact on the substrate after 12 hours of tumbling in a tumbler with sand, whereas a dry-applied molybdenum disulfide coating on bullets lasts only about 5 minutes when treated to the same tumbling in a tumbler with sand.

Accordingly, contrary to dry-applied molybdenum disulfide coatings, the liquid-applied compositions of the invention display stronger tendencies to remain on the substrate surface. Again while choosing to not be bound by theory, applicant contemplates that the conditioner material particles in the conditioning composition coalesce with each other and with the binder as the liquid carrier materials evaporate.

Thus, the orientation and dispersion of the conditioning composition particles create a layer coating which not only smooths out the peaks of the underlying substrate, the conditioner material particles also generally fill in the intervening valleys. Accordingly, the ballistic conditioning composition layer coating is generally thinner at the peaks and thicker in the valleys, thereby to present an external surface made up entirely of the ballistic conditioning composition, in binder, and wherein the external surface is overall smoother than the underlying surface of the underlying metal substrate. Further, since the conditioner material particles are arranged in the conditioning layer coating in generally random orientations, the particles generally work to interlock each other into the layer coating, thereby to strengthen the overall integrity of the conditioning layer coating.

While the above discussion teaches aerosol spray-applying the conditioning composition onto bullets, the suspension can as well be applied by dip-coating the bullets, or quenching shotgun shot, in a container of such material, so long as the material is subjected to suitable agitation to maintain a generally uniform such suspension long enough to complete the desired dip-coating. A single dipping is generally suitable to apply a layer of suitable thickness to the bullets. The shot can also be coated with the direct spray method.

The dip coating method is particularly suitable for coating cartridges wherein the bullet has already been assembled to the casing, including the filling therein of the propellant, and installation of the primer. An advantage of dip coating the fully assembled cartridge is that one can simultaneously coat the bullet and the neck of the cartridge. Using such method, the coating on the bullet is effectively used along the length of the barrel of the gun, while the coating on the neck treats, and thus conditions the shoulder of the firing chamber. Such cartridges e.g. with explosive primer and propellant are, of course, not suitable for "tumbling" as in the method taught in Martin U.S. Pat. No. 4,454,175.

Where spraying is the preferred method of application, but where sensitivity to release of aerosol propellant into the air suggests rejecting use of aerosol, the above liquid suspension can be applied by a wide variety of known conventional air or airless non-aerosol spray equipment.

The conditioning compositions of the present invention are generally compatible with the various lubricants found on lead center-fire and rimfire bullets. The composition is e.g. sprayed over the existing lubricants and produces improved results over such lubricated bullets.

Using the methods of the present invention, bullet manufacturers can easily blend conditioner materials of the invention into their current lubricant coatings and can apply the conditioner material enriched lubricant using their current methods of application. Generally, the amount of conditioner material added to existing lubes or anti-corrosion coatings will be, in the general formulation, the volumetric equivalent of ½ to 3 lbs. of molybdenum disulfide per gallon of binder/vehicle/lubricant composition.

In another embodiment of the invention, lead or steel shot is coated and/or conditioned with a relatively inert, non-toxic, insoluble, indigestible, stable and durable layering or coating of the ballistic conditioning composition such that the layer or coating will not degrade, or be removed from the shot during the internal ballistic experience of being fired through a firearm.

To coat the shot, the shot can be sprayed while moving on an oscillating or vibrating surface or on a conveyance. In this way, the entire surface of the shot is exposed to the spray resulting in a relatively even and substantial coating of desired thickness.

In addition to use in coating firearm projectiles with a uniform coating of the ballistic conditioning composition, the ballistic conditioning compositions of the invention can be employed to coat and ballistically condition the bore of a firearm barrel. In these embodiments, the liquid composition can be applied to the inside surface of the barrel by spraying or pouring a suitable stream of the liquid composition into an upstanding barrel of the gun, and catching excess flow-through amounts, if any, at the opposing end of the barrel.

Optionally, the coated bore of the firearm is brushed with a soft bore brush or bore mop to uniformly distribute the conditioning composition before the conditioning composition dries to leave the resultant dried conditioning coating. While the conditioning composition can be applied to a barrel at any stage of the life of the barrel, the conditioning composition is preferably applied as part of the process of barrel manufacture. In this way, the barrel has the advantage of the conditioning coating as shipped from the barrel manufacturer. Further, the barrel has the benefit of the conditioner material having been applied under closely controlled and reproducible manufacturing conditions. Moreover, the barrel will never experience the harsh treatment of having a cartridge fired through it prior to having had the conditioning layer applied. Moreover, there is no need to "break in" the firearm barrel by alternate shooting and cleaning operations.

In one method of barrel manufacture contemplated by the present invention, the respective conditioning material layer is applied to the barrel immediately prior to the last machining step, in such a manner that the conditioner material is worked into the inner surface of the barrel during such last machining step. For example, in one method of manufacture, the rifling is imparted to the inner surface of the barrel by impressing the grooves in an existing surface. In this case, application of the lubricious conditioning coating composition to the barrel prior to impressing the rifling causes both the raised and depressed surfaces of the barrel rifling to be conditioned by working the conditioning material into the barrel surface by the heat and pressure generated in the rifling process.

Such pre-conditioned barrels coming from the manufacturer can thus be effectively provided with a protective and conditioning coating which reduces the susceptibility of the steel structure of the barrel to being damaged by cartridges fired therethrough.

In a second method of manufacturing firearm barrels, the barrel is first drilled and then machined to remove material to form the rifling. A first coating of the conditioning composition is applied to the drilled barrel prior to the step of machining the barrel to form the rifling. This machining of the barrel to produce the rifling produces the heat required to condition the barrel by working the conditioner material into the surface layer of the barrel in those areas where metal is not removed, but removes both metal and the overlying conditioner coating layer from the machined rifling grooves. A second coating of the same or a different conditioner material composition is then applied to the inner surface of the barrel. This second coating covers the rifling grooves which were scraped clean of conditioner material as a result of the rifling process, but does not have the benefit of having been temperature-hardened into the rifling grooves. This second coating step does, however, provide a uniform layer of the conditioning composition completely covering the inner surface of the barrel, including the rifling grooves. The second coating provides protection of the rifling grooves against corrosion and pitting by powder and primer by-products.

Moreover, to the extent the first layer, adhering to the rifling ridges was damaged in the process of forming the rifling grooves, thus removing some of the first conditioning composition, the second coat covers over the scraped-off areas. The areas of non-hardened surface of the raised rifling ridges in the barrel bore will become hardened in the process of firing bullets through the barrel, especially bullets bearing a conditioning composition coating or layer of the invention.

In any event, the non-hardened second coating protects the entire barrel bore from corrosion, and reduces retention of lead, and deposits of other leavings of bullets which have been fired through the barrel.

A further advantage can be obtained from applying a liquid coating of a conditioning composition of the invention to a firearm barrel in combination with machining steps used in fabricating the inner surface of the barrel. The conditioning composition coating can aid in the barrel fabrication process by, for example, reducing the incidence of surface cracks, holes, or other damage normally associated with such machining operations in the absence of the application of the conditioning composition.

Such treatment of the barrel can result in substantial extension of the useful life of the barrel. While an untreated barrel has a generally accepted use life of 1500 . 2000 rounds for some applications, the above treatment of a barrel can result in extension of such use life of the barrel to over 5000 to 8000 rounds or more for the same application.

If the barrel is not so treated by the barrel manufacturer, the use of bullets coated with a conditioning composition of the invention as described herein, typically gradually deposits a layer comprising conditioning material on the inner surface of the barrel. However, such deposit on the barrel is inherently less uniform and less controlled than a such layer applied under manufacturing conditions. Further, in the process of such application by use of bullets, the barrel is subjected to traverse of at least a few dozen such bullets through the barrel before the barrel is effectively coated. In the process, a significant amount of "normal" wear associated with use of an uncoated barrel thus occurs before the coating conditioning effect is fully in place to protect the barrel.

In preferred use of the invention, a barrel not previously conditioned by the manufacturer is coated before any bullets are fired through the barrel. Thus, even with the first bullet shot through the barrel, the barrel has the benefit of being protected by the conditioner material layer, thus to obtain benefit from use of the layer of conditioner material. FIG. 2 illustrates such coating layers 14 and 20 on both the bullet and the barrel.

Where the barrel is not so coated by the barrel manufacturer, e.g. at the factory, the user, as another option, can effectively apply a suitable such coating by directing an e.g. aerosol spray of the ballistic conditioning composition into the barrel, preferably from both ends, in no particular order. In such case, the basic ballistic conditioning layer will have been applied without the benefit of elevated temperature. However, the layer will have a desired conditioning effect of smoothing out the inner surface of the barrel.

The effects of depositing a coating of the selected ballistic conditioning composition on the inner surface of the barrel are many. First, the coating protects the barrel long-term from corrosion. The coating results in a reduced amount of residual material from the shell (e.g. powder, primer, and projectile residue) being left in the barrel after each shot, resulting in less material being available for abrading the barrel as the next projectile traverses through the barrel. Thus, a further affect of the coating is less abrasion at the inner surface of the barrel. If the coating has been temperature hardened in the process of barrel manufacture, the hardening process likely results from creation of reaction products which combine e.g. iron and/or carbon from the barrel with materials from the coating composition.

If the coating has not been applied by the barrel manufacturer, or the coating has been applied but not temperature hardened, then firing bullets through the barrel can progressively activate the hardening process whereby the conditioner material can react with components of the steel in the barrel to form a hardened layer likely containing some compounds of the nature recited above.

In addition, liquid application of the conditioning composition coating results in a layer which has fully distributed underlying support as opposed to a powder-applied dry coating.

In any event, where the above described layers 14 and 20 have been applied to both the bullet and the barrel, the interface between bullet and barrel is, for the most part, coating-to-coating. This minimizes, if not eliminates metal-to-metal contact between the bullet and the barrel (omitting from the definition of metal-to-metal contact that contact which occurs between the coating layers 14 and 20).

Thus, the liquid compositions of the invention are useful for treating bullets, barrels and other firearm components (rifle, pistol, shotgun, military artillery and others), loaded rifle and shotgun shells, and shotgun plastic wads.

Conditioning composition liquids of the invention can use therein, as part of the powder composition, other powdered materials which are compatible with use with the conditioner materials. Typically such other powdered materials are solid lubricants, used as additives, so long as a significant fraction of the suspended solid/powder material is at least one of the above recited conditioner materials, e.g. at least 10 percent by weight of a named conditioner material based on the combined weights of all such particulate solid lubricant or particulate solid conditioner materials. The amount of such other particulate solid suspended materials is no more than 90% by weight of the suspended material, preferably less than 10% by weight. In preferred suspension compositions, the suspended powder component comprises greater than 90% by weight, more preferably greater than 95% by weight, most preferably at least 98% by weight, of the recited conditioning materials. As in the above described compositions, the recited conditioner materials are preferred to be the only suspended materials present in any significant quantity.

It should be noted that in this application of ballistic conditioner materials to ballistics articles such as bullets, rifle shells, rifle and shotgun barrels, shotgun shells, shotgun wads, and the like, the conditioner materials appear to operate more as surface "conditioners" than as lubricants, as evidence by the fact that muzzle velocity of rifle bullets fired using such treatments are somewhat lower than the muzzle velocity of bullets fired without using such treatment.

The effects of coating bullets and/or the barrel as above with the recited ballistics conditioning compositions are many. First, there is no concern with unintentionally creating obstructions in the barrel, as can happen when bullets are coated with grease. Coated bullets leave less fouling in the barrel. With coated bullets, muzzle velocity is reduced, typically by about 3–5%. Coated bullets fly a flatter trajectory, with greater accuracy. When bullets or the barrel, or both, are coated, barrel life is extended. The shooter can shoot more bullets between cleanings of the barrel without loss of accuracy if either the bullets or the barrel or both are coated. Cleaning the barrel is easier, taking less time than if the bullets and/or barrel are uncoated. Given the effect of coating 20 on the barrel, the barrel is preferably cleaned with a soft brush or a soft swab or pad, without use of any solvent, as solvents are no longer necessary, because the components needing to be cleaned out of the barrel are not generally bonded to the conditioned barrel.

Coating either the bullets or the barrel will provide some benefits of the invention. However, the maximum benefits are obtained where both bullets and barrel are coated. In one case, a shooter has fired over 19000 rounds of 0.223 and 0.22–250 caliber bullets without using any bore cleaner, while maintaining or improving accuracy.

Bullets are not damaged in the process of being coated, as can happen with the Martin '175 impact plating process. In some instances, coating of the bullets results in concurrent degreasing such that the coating adheres. The coating process of the present invention is easy to use and takes only a few seconds, a few minutes if counting the time to install bullets in organizer 22. No extraneous material need be added to the conditioner material, whereby the coating contains no extraneous material other than the impurities normally found in commercially available grades of the conditioning materials. The resulting coated bullets have a smoother surface than impact plated bullets because no dents have been formed by any "impacting" activity.

Applicant's liquid composition can readily be applied anywhere liquid can be caused to flow, such as interior surfaces such as inside a gun barrel, or in or near the firing chamber of the gun. Using normal paint spraying application technique, an acceptable thickness layer of the conditioning composition can be obtained with little, if any, training or experience. The resulting product does not easily transfer the coating material off the bullet onto the user's hands. There is no risk of spillage of messy conditioner material e.g. powder. The coating can be applied to loaded cartridges.

In addition to the above benefits, when coatings of the invention are used, the rifling forms cleaner grooves in the bullets than if no coating is used. By using the liquid suspension as the vehicle for applying coatings of the invention, no wax or other vehicle need be used to retain the layer of conditioning composition in secure affixation to the underlying substrate surface.

The invention contemplates using spray application, whether aerosol or non-aerosol, air or airless, to apply a conditioning coating of the conditioning composition suspension to the inside surface of the barrel of the gun, whether rifle or shotgun. The resulting coating on the barrel is similar in nature to the coating described for bullets. The spray may be applied from either end of the barrel, or both ends.

An optional method is to use a bore mop to swab the composition onto the bore surface, and then apply a bore brush to finish smoothing out the coating.

While the above description has concentrated so far generally on use of the conditioning compositions for coating rifle bullets, rifle barrels, and rifle shells/cartridges, the recited conditioning compositions and coatings made therefrom apply as well to shotgun barrels, shotgun shells including plastic side walls thereof, and shotgun wads including plastic wads.

Shotgun barrels are treated in the same manner as rifle barrels, except that shotgun barrels generally carry no rifling. Shotgun shells can be coated in the entirety of their side walls, including brass and plastic. Shotgun wads can be coated in the above described spray application. The purpose for coating shotgun wadding is to reduce plastic fouling of the barrel.

The above illustrations of substrates and coatings are not intended to be limiting, but are offered as examples of the wide variety of ballistics-related substrates which can be coated with the respective ballistics conditioning compositions.

In view of the above, it is now clear that the invention can advantageously be applied to any ballistics article where there is high speed, high temperature interaction between solid surfaces, one of which is metal.

Thus, in the typical, and preferred embodiment of the invention, the gun barrel is liquid coated before even one shot is fired through the barrel. In addition, all bullets fired through the barrel are coated with a conditioning composition of the invention, thereby to provide coating-to-coating interaction between bullet and barrel, and replenishment of coating material from bullet to barrel as any coating material wears off the inside of the barrel.

In view of the above disclosure and description, those skilled in the art can now see that certain modifications can be made to the articles and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the invention as herein described.

Having thus described the invention, what is claimed is:

1. A ballistic conditioning composition for ballistic conditioning of firearms, firearm components, and firearm projectiles, said ballistic conditioning composition comprising:

(a) powder comprising (i) greater than 90 percent by weight of powdered conditioning material selected from the group consisting of tungsten disulfide, antimony trioxide, graphite, and hexagonal boron nitride and mixtures thereof, and (ii) zero to less than 10 percent by weight of a second compatible powdered material;

in a carrier comprising (b) a volatile solvent; and (c) a binder selected from the group consisting of cellulosic resins, alkyd resins, and acrylic resins, and mixtures thereof.

2. A composition as in claim 1 wherein said binder is selected from the group consisting of quick-drying cellulosic resins.

3. A composition as in claim 1 wherein said binder is selected from the group consisting of quick-drying alkyd resins.

4. A composition as in claim 1 wherein said binder is selected from the group consisting of quick-drying acrylic resins.

5. A composition as in to claim 1 comprising about 0.2–1.9 lb of said conditioner material per gallon of said carrier.

6. A composition as in claim 1 wherein greater than 95 percent by weight of said powder comprises said conditioner material.

7. A composition as in claim 1 wherein greater than 98 percent by weight of said powder comprises said conditioner material.

8. A composition as in claim 1 wherein said powdered conditioning material comprises about 5 percent by weight to about 20 percent by weight of antimony trioxide, in combination with at least one of said hexagonal boron nitride, said tungsten disulfide, and said graphite.

9. A composition as in claim 1 wherein said powdered conditioning material comprises about equal parts by weight hexagonal boron nitride and tungsten disulfide.

10. A method for ballistic conditioning of bullets comprising applying to the bullets a coating of a conditioning composition of claim 1 and thereby depositing on the bullets a coating comprising the conditioner material and binder.

11. A method for ballistic conditioning of bullets comprising applying to the bullets an aerosol spray of a conditioning composition of claim 1.

12. A method for ballistic conditioning of bullets comprising applying to the bullets an airless spraying, air-assisted spraying, air brush, or spray pumper application of a conditioning composition of claim 1.

13. A method as in claim 11, including heating the bullets to a temperature of about 80 degrees F. to about 150 degrees F. prior to the aerosol application of the conditioning composition to the bullets.

14. A method as in claim 10 wherein a thickness of the coating of conditioner material plus binder is about 0.002 inch to about 0.01 inch.

15. A method of ballistic conditioning wire for swaged bullets comprising applying a coating of a conditioning composition of claim 1 to the wire prior to drawing the wire through a wire drawing die.

16. A method as in claim 15 including applying a coating of a conditioning composition of claim 1 after drawing the wire through a first wire drawing die, and prior to drawing the wire through a second or subsequent wire drawing die, thereby utilizing heating caused by drawing the wire through a prior wire drawing die to assist in conditioning the wire with the conditioning composition.

17. A method for ballistic conditioning fully loaded ammunition cartridges comprising applying, to the cartridges, a coating of a conditioning composition of claim 1.

18. A method of providing a corrosion-protective coating on shotgun shell shot comprising applying to the shot a conditioning composition of claim 1.

19. Shotgun shell shot having a coating comprising a said conditioning composition of claim 1.

20. A ballistic conditioning composition for ballistic conditioning of firearms, firearm components, and firearm projectiles, said ballistic conditioning composition comprising:

(a) powder comprising (i) about 10 percent by weight to 100 percent by weight of powdered conditioner material selected from the group consisting of tungsten disulfide, graphite, hexagonal boron nitride, antimony trioxide, talc, mica, and mixtures thereof, said powdered conditioner material comprising about 5 percent by weight to about 20 percent by weight antimony trioxide, in combination with at least one of said tungsten disulfide and said graphite, and (ii) zero up to about 90 percent by weight of a second compatible powdered material;

in a carrier comprising (b) a volatile solvent; and (c) a binder selected from the group consisting of cellulosic resins, alkyd resins, and acrylic resins, and mixtures thereof.

21. A composition as in claim 20 wherein said binder is selected from the group consisting of quick-drying cellulosic resins.

22. A composition as in claim 20 wherein said binder is selected from the group consisting of quick-drying alkyd resins.

23. A composition as in claim 20 wherein said binder is selected from the group consisting of quick-drying acrylic resins.

24. A composition as in to claim 20 comprising about 0.2–1.9 lb of said conditioner material per gallon of said carrier.

25. A composition as in claim 20 wherein greater than 95 percent by weight of said powder comprises said conditioner material.

26. A composition as in claim 20 wherein greater than 98 percent by weight of said powder comprises said conditioner material.

27. A method for ballistic conditioning of bullets comprising applying to the bullets a coating of a conditioning composition of claim 20 and thereby depositing on the bullets a coating comprising the conditioner material and binder.

28. A method for ballistic conditioning of bullets comprising applying to the bullets an aerosol spray of a conditioning composition of claim 20.

29. A method for ballistic conditioning of bullets comprising applying to the bullets an airless spraying, air-assisted spraying, air brush, or spray pumper application of a conditioning composition of claim 20.

30. A method as in claim 28, including heating the bullets to a temperature of about 80 degrees F. to about 150 degrees F. prior to the aerosol application of the conditioning composition to the bullets.

31. A method as in claim 25 wherein a thickness of the coating of conditioner material plus binder is about 0.0025 inch to about 0.005 inch.

32. A method of ballistic conditioning wire for swaged bullets comprising applying a coating of a conditioning composition of claim 20 to the wire prior to drawing the wire through a wire drawing die.

33. A method as in claim 32 including applying a coating of the conditioning composition after drawing the wire through a first wire drawing die, and prior to drawing the wire through a second or subsequent wire drawing die, thereby utilizing heating caused by drawing the wire through a prior wire drawing die to assist in conditioning the wire with the conditioning composition.

34. A method for ballistic conditioning fully loaded ammunition cartridges comprising applying, to the cartridges, a coating of a conditioning composition of claim 20.

35. A method of providing a corrosion-protective coating on shotgun shell shot comprising applying to the shot a conditioning material of claim 20.

36. Shotgun shell shot having a coating comprising a said conditioning material as in claim 20.

37. A method for producing ballistic conditioned copper-clad bullets comprising applying, to sheet copper prior to forming the sheet copper into jackets for the bullets, conditioner material selected from the group consisting of hexagonal boron nitride, graphite, tungsten disulfide, antimony trioxide, talc, mica, and mixtures thereof.

38. A method as in claim 37, including applying the conditioning material in a coating having an overall thickness of about 0.002 inch to about 0.005. inch.

39. A firearm projectile, comprising:

(a) a substrate; and (b) a coating on said substrate, said coating comprising a composition comprising a conditioner material selected from the group consisting of hexagonal boron nitride, graphite, tungsten disulfide, antimony trioxide, mica, talc, and mixtures thereof, in a binder selected from the group consisting of cellulosic resins, alkyd resins, and acrylic resins.

40. A firearm projectile as in claim 39 wherein said coating has a thickness of about 0.002 inch to about 0.005 inch.

41. A firearm projectile as in claim 39, selected from the group consisting of lead bullets, copper-clad lead bullets, and ammunition cartridges loaded with propellant.

42. A firearm having a barrel, said barrel having a coating on a bore thereof, said coating comprising a conditioner material selected from the group consisting of hexagonal boron nitride, graphite, tungsten disulfide, antimony trioxide, mica, talc, and mixtures thereof, and a binder selected from the group consisting of cellulosic resins, alkyd resins, and acrylic resins.

43. A method of ballistically conditioning a bore of a barrel of a firearm comprising applying to the bore a coating of a conditioning composition comprising powdered conditioner material selected from the group consisting of hexagonal boron nitride, graphite, tungsten disulfide, antimony trioxide, mica, talc, and mixtures thereof, in a carrier comprising a volatile solvent and a binder selected from the group consisting of cellulosic resins, alkyd resins, acrylic resins, and mixtures thereof.

44. A method as in claim 43, including applying the conditioning composition prior to forming rifling within the bore of the barrel, and subsequently forming rifling within the bore of the barrel.

45. A method as in claim 43 including, after coating the bore of the barrel with the conditioning composition, heating the barrel to a temperature sufficient to cause the conditioner material to react with components of the barrel to increase hardness of a surface region of the bore.

46. A method as in claim 45 wherein the heating of the barrel comprises repeated firing of projectiles through the barrel of the firearm to cause the rise in temperature sufficient to cause the conditioner material to react with components of the barrel to form the surface region of increased hardness.

47. A method as in claim 46, including firing, through the barrel, projectiles coated with a conditioner material of claim 43.

48. A ballistic conditioning composition for ballistic conditioning of firearms, firearm components, and firearm projectiles, said ballistic conditioning composition comprising:

(a) powder comprising (i) about 10 percent by weight to 100 percent by weight of powdered conditioner material selected from the group consisting of tungsten disulfide, graphite, antimony trioxide, talc, mica, and mixtures thereof, and (ii) zero up to about 90 percent by weight of a second compatible powdered material, not including molybdenum disulfide;

in a carrier comprising (b) a volatile solvent; and (c) a binder selected from the group consisting of cellulosic resins, alkyd resins, and acrylic resins, and mixtures thereof.

49. A composition as in claim 48 wherein said binder is selected from the group consisting of quick-drying cellulosic resins.

50. A composition as in claim 48 wherein said binder is selected from the group consisting of quick-drying alkyd resins.

51. A composition as in claim 48 wherein said binder is selected from the group consisting of quick-drying acrylic resins.

52. A composition as in to claim 48 comprising about 0.2–1.9 lb of said conditioner material per gallon of said carrier.

53. A composition as in claim 48 wherein said powdered conditioning material comprises about equal parts by weight hexagonal boron nitride and tungsten disulfide.

54. A method for ballistic conditioning of bullets comprising applying to the bullets a coating of a conditioning composition of claim 48.

55. A method as in claim 54 wherein a thickness of the coating of conditioner material plus binder is about 0.002 inch to about 0.01 inch.

56. A method of ballistic conditioning wire for swaged bullets comprising applying a coating of a conditioning composition of claim 48 to the wire prior to drawing the wire through a wire drawing die.

57. A method as in claim 56 including applying a coating of a conditioning composition of claim 48 after drawing the wire through a first wire drawing die, and prior to drawing the wire through a second or subsequent wire drawing die, thereby utilizing heating caused by drawing.the wire through a prior wire drawing die to assist in conditioning the wire with the conditioning composition.

58. A method for ballistic conditioning fully loaded ammunition cartridges comprising applying, to the cartridges, a coating of a conditioning composition of claim 48.

59. Shotgun shell shot having a coating comprising a said conditioning composition of claim 48.

60. A ballistic conditioning composition as in claim 48 wherein said powdered conditioning material comprises hexagonal boron nitride.

61. A ballistic conditioning composition as in claim 1 wherein said powdered conditioning material comprises hexagonal boron nitride.

62. A method as in claim 12 wherein said powdered conditioning material comprises hexagonal boron nitride.

63. A method as in claim 17 wherein said powdered conditioning material comprises hexagonal boron nitride.

64. A ballistic conditioning composition as in claim 20 wherein said powdered conditioning material comprises hexagonal boron nitride.

65. A method as in claim 27 wherein said powdered conditioning material comprises hexagonal boron nitride.

66. A method as in claim 34 wherein said powdered conditioning material comprises hexagonal boron nitride.

67. A firearm projectile as in claim 39, wherein said powdered conditioning material comprises hexagonal boron nitride.

68. A firearm as in claim 42 wherein said powdered conditioning material comprises hexagonal boron nitride.

69. A method as in claim 43 wherein said powdered conditioning material comprises hexagonal boron nitride.

70. A method for ballistic conditioning bullets, comprising applying to the bullets a coating of a conditioner material-enriched lubricant wherein the conditioner material comprises a conditioning composition as in claim 1.

71. A method for ballistic conditioning bullets, comprising applying to the bullets a coating of a conditioner material-enriched lubricant wherein the conditioner material comprises a conditioning composition as in claim 20.

72. A firearm projectile as in claim 39 wherein said coating comprises a lubricant enriched with said conditioning material.

* * * * *